United States Patent [19]

Schmidt

[11] Patent Number: 4,750,906

[45] Date of Patent: Jun. 14, 1988

[54] PROCESS FOR THE RETANNING OF MINERAL TANNED LEATHER

[75] Inventor: Rudolf Schmidt, Worms, Fed. Rep. of Germany

[73] Assignee: Benckiser-Knapsack GmbH, Ladenburg, Fed. Rep. of Germany

[21] Appl. No.: 703,551

[22] Filed: Feb. 20, 1985

[30] Foreign Application Priority Data

Feb. 25, 1984 [DE] Fed. Rep. of Germany ..... 3406912

[51] Int. Cl.[4] ..... C14C 3/06

[52] U.S. Cl. ..... 8/94.18; 8/94.26

[58] Field of Search ..... 8/94.19 R, 94.19 C, 8/94.33, 94.1 R, 94.27; 536/312; 525/329.5, 329.6, 329.7, 353, 360, 437

[56] References Cited

U.S. PATENT DOCUMENTS

| | | | |
|---|---|---|---|
| 3,727,689 | 4/1973 | Clampitt | 166/283 |
| 3,744,969 | 7/1973 | Alps | 8/94.21 |
| 4,190,687 | 2/1980 | Sugiura et al. | 8/94.1 R |
| 4,314,800 | 2/1982 | Monsheimer et al. | 8/94.19 R |

FOREIGN PATENT DOCUMENTS

| | | |
|---|---|---|
| 208556 | 12/1983 | Czechoslovakia . |
| 0029906 | 6/1981 | European Pat. Off. . |
| 2127959 | 12/1971 | Fed. Rep. of Germany . |
| 2755087 | 12/1978 | Fed. Rep. of Germany . |

OTHER PUBLICATIONS

Chemical Abstracts, 100:176849f, Band 100, No. 22, May 1984, Columbus, Ohio.

Von H. Fikentscher, "Systematik der Cellulosen auf Grund ihrer Viskositaet in Loesung", Eing. 12, 11/1931.

Von H. Fikentscher, "Systematik der Cellulosen auf Grund ihrer Viskositaet in Loesung", Heft 3, 1932.

*Primary Examiner*—A. Lionel Clingman

*Assistant Examiner*—John F. McNally

*Attorney, Agent, or Firm*—Foley & Lardner, Schwartz, Jeffery, Schwaab, Mack, Blumenthal & Evans

[57] ABSTRACT

The present invention concerns retanning agents for mineral tanned leathers. They comprise aqueous solutions of organic polymer complex compounds containing carboxyl groups doped with chromium III. The agents are characterized by high chromium depletion and retanning effects.

15 Claims, No Drawings

PROCESS FOR THE RETANNING OF MINERAL TANNED LEATHER

BACKGROUND OF THE INVENTION

Principal tanning with mineral tanning substances alone is not sufficient to provide finished leathers with the many properties required of them. In order to enhance specific properties or even to initially obtain them, retanning is added to the principal tanning process. However, in addition to the quality desired by subsequent processors, leather manufacturers must take into account a considerable number of environmental conditions. A principal condition concerns chromium in waste waters introduced by a principal mineral tanning process with various chromium tanning substances. Numerous operating plants are therefore forced either to have the stage of principal tanning performed by installations capable of recovering chromium from residual tanning liquors or to further process wet-blue commercial goods available on the market and already chromium tanned. This, however, does not solve problems of this type. In the course of the further processing of wet-blue goods, an astonishingly large amount of chromium, i.e., too much chromium is still passed from the leather into the waste waters.

The concentration of chromium in the rinsing or retanning liquors is largely dependent on the chromium fixing ability of the retanning agent, which is around 0.1–2 g $Cr_2O_3$/l of the residual liquor in the present state of the art. Because a permissible amount of chromium in waste waters is attained below about 2 mg Cr/l (=2.9 mg $Cr_2O_3$/l), considerable problems arise with the amounts of chromium usually obtained, which exceed the above limit. There has therefore been no lack of attempts to reduce the problem, generally by special processes and/or auxiliary means, but it has not heretofore been possible in actual practice to reduce the chromium concentration of the residual liquors appreciably under 0.1 g $Cr_2O_3$/l without affecting the quality of the leather.

German Offenlegungsschrift No. 27 55 087 describes pretanning of smoothed skins wherein final tanning process concentrations of 0.13 g $Cr_2O_3$/l, 0.28 g $Cr_2O_3$/l and 0.3 g $Cr_2O_3$/l are obtained in the residual liquor by means of polymers of monomers containing carboxyl groups. The polymers are alleged to be suitable for retanning also. In German Offenlegungsschrift No. 31 41 496 copolymers of polyacrylamide and methacrylamide with cationic groups are recommended for retanning, principally for dyeing effects, yet without abnormal chromium fixation effects.

The producers of polymer tanning substances frequently recommend rinsing the leather prior to retanning, which obviously leads to the contamination of waste waters with inadequately fixed chromium. Other types of polymer tanning substances are sensitive to acids and form precipitates so that prior to their use chrome leathers must be additionally neutralized. Depending on the neutralizing agent used, particularly high chromium concentrations may be produced in the waste waters.

In achieving the properties of the leather, external appearance plays an important role. Thus, for example, leathers with the lightest possible original coloring are sought so as to allow very pastel or clear color tones to be dyed in. The same requirements also apply to leathers which are dried without dyeing and stored, to be colored later—depending on the prevailing fashions—by means of the so-called cop dyeing process. The versatility of such leathers with respect to coloring depends very greatly on the presence of a light, neutral base coloring.

The action of the polymer tanning agents may be described in relation to the properties of the leather generally in that the leathers treated with them are soft and more or less full and firmly grained. It should be noted, however, that of polymer tanning agents designated as firm-graining, the term "firm-grained" is relatively flexible and does not approach the usual standard of specially developed auxiliary agents, such as for example that of leather treated with polyphosphates.

However, polyphosphates are at a disadvantage in coloring with very clear dyes, as the leathers receive a greenish color cast as the base color, thereby introducing achromatic components in the complementary range. Furthermore, polyphosphates are not able to produce very strong consumption values required.

SUMMARY OF THE INVENTION

It is therefore an object of the present invention to provide a retanning process for mineral tanned, particularly chrome tanned leathers, leading both to a very high lightness of the leather and a very slight contamination of the waste waters produced. This object is attained by the process according to the present invention.

The chromium doped chromium polymer complexes used in the process are novel and they may be prepared in the manner characterized by the present invention.

The complexes of polymer compounds with trivalent chromium according to the invention, represent highly surprising auxiliary means, whereby chromium consumption far in excess of the state of the art is obtained, together with a simultaneous retanning effect, even though additional chromium is being introduced in the retanning system. The leathers treated with the polymer complexes according to the invention are unusally solid-grained, while their softness is preserved, representing an additional improvement with regard to the state of the art. A further advantage that should not be underestimated, comprises the very light base color, far exceeding the usual degree. The polymer complexes according to the invention are insensitive to acids and exchange the undesirable acid residues present in the leather, so that the process step of neutralization in the conventional sense may be eliminated. Alkaline additions are still possible; they serve the establishment of the pH range desired.

In the case of leathers tanned with aluminum tanning agents, the polymer complexes according to the invention improve the solidity of graining, particularly in the loose skin regions. The yellow cast characteristic of leathers tanned with aluminum may be compensated for very well in the process according to the invention.

By adjusting the doping ratio, i.e., the ratio of the polymer components to the chromium content, a surprising range of selection is provided between the lightness of the leather and the chromium content of the waste waters. Even at low chromium contents, the contamination of the waste water is lower than the state of the art.

The preparation of the polymer complexes themselves is exceptionally simple, as may be seen from the exemplary embodiments.

It is sufficient to mix polymers containing carboxyl groups, preferably acid polymers and/or copolymers, in an aqueous solution with a soluble chromium compound (chromium sulfate for example) and to heat the solution until the complexing reaction occurs.

The preferred polymers/copolymers are those of acrylic acid and/or methacrylic acid, maleic acid and/or their hydroxy compounds, which may also be present in the form of fully or partially neutralized salts.

The preferred doping ratio of chromium to the carboxyl groups of the polymers is between 1:500 and 1:1, preferably between 1:50 and 1:3, wherein the polymer K-values according to Fikentscher are between 5 and 120, preferably between 10 and 50.

The retanning process is not in itself critical. The piece of leather is wetted with the necessary amount of water, with rinsing optionally omitted, the complex solution added and the leather tumbled in a tanning drum.

Fat-liquor and sodium hydrogen carbonate are added in a known manner.

Further objects, features and advantages of the present invention will become apparent from the detailed description of preferred embodiments which follows by way of several non-limiting examples.

DETAILED DESCRIPTION OF THE PREFERRED EMBODIMENTS

In the examples described hereinafter the brightness of the surface of the undyed leather was measured with an elecric reflectance photometer (ELREPHO) with the use of Y filters to determine the brightness (=E-value). The resulting relative number signifies that the higher the number of the E-value, the brighter the surface. For example, white $BaSO_4$ powder has a value of 100. Pieces of leather attaining or even exceeding a value of 60 may be designated extraordinarily bright.

In the following examples, the improvements achieved with regard to leather and waste water quality are further demonstrated. All of the examples are based on the same wet-blue material, with the best reproducibility of the leather to the wet-blue stage being assured by the use of the same raw material, chemicals, processing techniques and mechanical processes. The shaved thickness of this initial material amounted to 1.8/1.9 mm. The percentual data refer to the shaved weight of the wet-blue pieces.

EXAMPLE 1

A wet-blue piece was introduced without previous rinsing into a bath of 300% water at 45° C., together with 4% of a commercial, 33% sodium polyacrylate solution (e.g., Utanit 417, a product of Benckiser-Knapsack) and tumbled in a tanning drum for one hour. This neutralizing liquor was drained and the chromium content determined. The piece of leather was rinsed, treated with an amount, standardized for this series, of 7% a mixture of commercial fat-liquors and finished. The result was a very soft, not very solid-grained, moderately filled but only slightly brightened leather.

Chromium content of the residual liquor: 100 mg $Cr_2O_3$/l. E-value of the finished leather: 53.5.

EXAMPLE 2

Under the conditions of Example 1 a wet-blue piece was treated with 5% of a 25% solution of a commercial polymer product (e.g., Granofin M, a product of Heochst AG) based on polyacrylamide in place of the sodium polyacrylate solution and finished. The result is a less soft, moderately filled, dark leather with moderately solid graining.

Chromium content of the residual liquor: 199.6 mg $Cr_2O_3$/l. E-value of the finished leather: 51.3.

EXAMPLE 3

500 g of a polyacrylic acid prepared by a known process with a content of 33% and a K-value according to Fikentscher of approximately 23, corresponding to the sodium polyacrylate cited in Example 1, were mixed with 16.7 g of a 33% basic chromium sulfate and agitated until completely dissolved. In place of the 33% basic chromium sulfate, other soluble chromium compounds may also be used, the preference found in the following examples is for economic reasons. The solution is heated to 80° C., at which temperature the complexing reaction takes place. After cooling to room temperature, a free-flowing water-soluble complex is obtained. The doping ratio is approximately 40 carboxyl groups per chromium atom.

A wet-blue piece of leather was reacted with 300% water at 45° C. and 5% of the above-described complex solution without preliminary rinsing and tumbled for one hour in a tanning drum. Following the addition of 1% sodium hydrogen carbonate and a tumbling duration of 15 min, 7% of the fat-liquor mixture and another 1% sodium hydrogen carbonate were added and tumbling continued for 45 min. The finished leather was soft, more solidly grained, as in Example 1, and of a very bright color.

Chromium content of the compact residual liquor: 10.1 mg $Cr_2O_3$/l. E-values of the finished leather: 60.3.

EXAMPLE 4

500 g of a 40% polyacrylic acid prepared by a known process with a K-value according to Fikentscher of 18 were mixed with 20.3 g of a 33% basic chromium sulfate with stirring and dissolved. The mixture was heated with stirring to 80° C. and then cooled. A free-flowing, water soluble complex with a doping ratio of approximately 40 carboxyl groups per chromium atom was obtained.

A wet-blue piece of leather was tumbled without preliminary rinsing with 300% water a 45° C. and 5% of the above complex solution and tumbled in a tanning drum for one hour.

Subsequently, 0.9% of sodium di-carbonate was added, the tumbling continued for 15 min. Then, an additional 0.6% sodium bicarbonate was added, together with 7% of a mixture of fat-liquors, and tumbling continued for another 45 min. A soft, bright, filled and solid-grained leather was obtained.

Chromium content of the residual liquor: 35.5 mg $Cr_2O_3$/l. E-value of the finished leather: 61.4.

EXAMPLE 5

3000 g of a 40% polyacrylic acid prepared by a known process with a K-value according to Fikentscher of approximately 18, were mixed with 121.8 g of a 33% basic chromium sulfate and agitated until completely dissolved. Following heating to 80° C. and subsequent cooling, a high viscosity but water soluble paste is obtained with a doping ratio of approximately 40 carboxylic groups per chromium atom.

A wet-blue piece was combined without previous rinsing with 5% of the above paste and 300% water at 45° C. and tumbled for one hour in a tanning drum.

Subsequently, 0.8% sodium bi-carbonate was added and tumbling continued for 15 min. Then, 7% of a mixture of fat-liquors and 1% sodium bi-carbonate were added. After tumbling for an additional 45 min, the piece of leather is finished as before. A more solid, but still soft, bright leather with very good solid-graining was obtained.

Chromium content of the residual liquor: 8.9 mg $Cr_2O_3$/l. E-value of the finished leather: 59.6.

EXAMPLE 6

250 g of a 40% polyacrylic acid prepared by a known process, with a K-value according to Fikentscher of approximately 18, were diluted with 12.5 ml distilled water and mixed with 10.2 g of 33% basic chromium sulfate. The initial mixture was heated with stirring to 80° C. and cooled. A well flowing, water soluble complex with a doping ratio of approximately 40 carboxyl groups per chromium atom was obtained.

A wet-blue piece was treated in a manner exactly corresponding to that of Example 5 with a 5% complex solution. A slightly softer, bright leather still having good solid-graining resulted.

Chromium content of the residual liquor: 11.4 mg $Cr_2O_3$/l. E-value of the finished leather: 60.4.

EXAMPLE 7

250 g of a 40% polyacrylic acid prepared by a known process, with a K-value according to Fikentscher of approximately 18, was diluted with 250 ml distilled water, mixed with 40.6 g 33% basic chromium sulfate, heated to 75° C. and cooled. The result consisted of a highly viscous but still water soluble paste with a doping ratio of 10 carboxyl groups per chromium atom.

A wet-blue piece was treated exactly in the manner of Examples 5 and 6 with 5% of the above paste. A soft, full, not very solid-grained, but very bright leather was obtained.

Chromium content of the residual liquor: 11.4 mg $Cr_2O_3$/l. E-value of the finished leather: 61.1.

EXAMPLE 8

By means of a known process, a 32% methacrylic acid copolymer, with a K-value according to Fikentscher of approximately 20, was prepared from a monomer component of 90% acrylic acid and 10% methacrylic acid, and neutralized with sodium hydroxide to pH 7.5. 2000 g of this neutralized methylacrylic acid copolymer were mixed with a solution of 63.7 g 33% basic chromium sulfate and heated to 80° C. A free-flowing complex solution was obtained.

A wet-blue piece was combined without previous rinsing with 300% water at 45° C. and 5% of the above solution and tumbled for one hour in a tanning drum. Subsequently, the liquor was drained off and analyzed for chromium. The piece of leather was washed in 200% water at 60° C. over a tumbling period of 10 min. Thereafter 7% of a fat-liquor mixture was added to a new liquor of 200% water at 60° C. The mixture was tumbled for 20 min, and the fatty substances of the liquor fixated with 0.5% formic acid during an additional 45 min tumbling period.

The finished leather was soft, astonishingly solid-grained and extraordinarily bright.

Chromium content of the residual liquor: 60.8 mg $Cr_2O_3$/l. E-value of the finished leather: 63.6

Summary of the Data of Chromium Consumption in the Liquor and of the Brightness of Leather Surfaces

| Example | $Cr_2O_3$/l | E-value |
|---|---|---|
| 1 (state of the art) | 100.0 mg | 53.5 |
| 2 (state of the art) | 199.6 mg | 51.3 |
| 3 (process according to the invention) | 10.1 mg | 60.3 |
| 4 (process according to the invention) | 35.5 mg | 61.4 |
| 5 (process according to the invention) | 8.9 mg | 59.6 |
| 6 (process according to the invention) | 11.4 mg | 60.4 |
| 7 (process according to the invention) | 11.4 mg | 61.1 |
| 8 (process according to the invention) | 60.8 mg | 63.6 |

What is claimed is:

1. A process for the retanning of mineral tanned leather, particularly chrome tanned leather, comprising the steps of:

(a) doping an organic component having carboxyl groups with chromium III in an aqueous solution at a temperature between about 60° and about 80° C., whereby a water-soluble organic polymer complex is formed;

wherein said organic component is selected from acid polymers of a first group consisting of acrylic acid, methacrylic acid, maleic acid, a hydroxy compound of acrylic acid, a hydroxy compound of methacrylic acid, and a hydroxy compound of maleic acid; copolymers of members of said first group; and salts of said polymers and copolymers; and (b) treating mineral-tanned leather with said organic polymer complex in an aqueous bath at elevated temperatures.

2. A process according to claim 1, wherein said organic component comprises a fully neutralized salt.

3. A process according to claim 1, wherein said organic component comprises a partially neutralized salt.

4. A process according to claim 1, wherein said chromium III is selected from the group consisting of water-soluble chromium salts, and alkalized chromium salts.

5. A process according to claim 1, wherein said chromium comprises chromium sulfate.

6. A process according to claim 1, wherein said organic component has a K-value according to Fikentscher in the range from about 5 to about 120.

7. A process according to claim 1, wherein said organic component has a K-value according to Fikentscher in the range from about 10 to about 50.

8. A process according to claim 1, further comprising the step of doping said organic component with said chromium III to form said organic polymer complex, wherein said organic component comprises from about 1% to about 80% by weight of said organic polymer complex.

9. A process according to claim 1, wherein said organic component comprises from about 5% to about 60% by weight of said organic polymer complex.

10. A process according to claim 1, wherein said organic component comprises from about 10% to about 40% by weight of said organic polymer complex.

11. A process according to claim 1, wherein said chromium III salt comprises an alkalized chromium salt.

12. A process according to claim 1, wherein said chromium III salts comprise alkalized chromium sulfate.

13. A process according to claim 1, wherein said chromium III is present in a molar ratio to said carboxyl groups of from about 1:500 to about 1:1.

14. A process according to claim 1, wherein said chromium III is present in a molar ratio to said carboxyl groups of from about 1:50 to about 1:3.

15. A process according to claim 1, wherein said aqueous retanning bath comprises from about 0.1% to about 20% by weight organic polymer complex.

* * * * *